United States Patent [19]

Stotz

[11] 4,359,020

[45] Nov. 16, 1982

[54] PRELIMINARY HEATING INSTALLATION FOR GLOW PLUGS IN AIR-COMPRESSING INTERNAL COMBUSTION ENGINES

[75] Inventor: Manfred Stotz, Aichwald, Fed. Rep. of Germany

[73] Assignee: Daimler-Benz A.G., Stuttgart, Fed. Rep. of Germany

[21] Appl. No.: 157,937

[22] Filed: Jun. 9, 1980

Related U.S. Application Data

[63] Continuation of Ser. No. 930,196, Aug. 2, 1978, abandoned.

[30] Foreign Application Priority Data

Aug. 2, 1977 [DE] Fed. Rep. of Germany ..... 2734718

[51] Int. Cl.[3] ..... F02N 17/00

[52] U.S. Cl. ..... 123/145 A; 123/179 B

[58] Field of Search ..... 123/179 A, 179 B, 179 BG, 123/145 A, 143 A, 169 EL

[56] References Cited

U.S. PATENT DOCUMENTS

| | | | |
|---|---|---|---|
| 2,007,508 | 7/1975 | Talmery | 123/145 A |
| 2,606,544 | 9/1949 | Church et al. | 123/145 A |
| 3,765,380 | 10/1973 | Rachel et al. | 123/32 EJ |
| 3,824,966 | 7/1974 | Schnieder et al. | 123/32 EJ |
| 3,880,125 | 4/1975 | Kammerer et al. | 123/32 EJ |
| 3,975,951 | 8/1976 | Kohama et al.' | 123/32 EJ |
| 4,088,109 | 5/1978 | Woodruff et al. | 123/79 BG |
| 4,089,214 | 5/1978 | Egami et al. | 123/32 EJ |
| 4,103,661 | 8/1978 | Holt | 123/179 B |
| 4,106,465 | 8/1978 | Bernhardt et al. | 123/179 BG |
| 4,121,545 | 10/1978 | Mizote | 123/32 EJ |

FOREIGN PATENT DOCUMENTS

| | | | |
|---|---|---|---|
| 2205108 | 11/1972 | Fed. Rep. of Germany | 123/179 BG |
| 1299589 | 12/1972 | Fed. Rep. of Germany | 123/179 BG |
| 2460928 | 6/1976 | Fed. Rep. of Germany | 123/179 BG |

*Primary Examiner*—Raymond A. Nelli
*Attorney, Agent, or Firm*—Paul M. Craig, Jr.

[57] ABSTRACT

A preliminary heating installation for glow plugs in air-compressing internal combustion engines, in which a delay circuit is provided that enables from the beginning of the preliminary heating and for a predetermined duration a superincreased heating current by at least partially short-circuiting a series resistance; a heating spiral is selectively provided in the suction air path.

4 Claims, 1 Drawing Figure

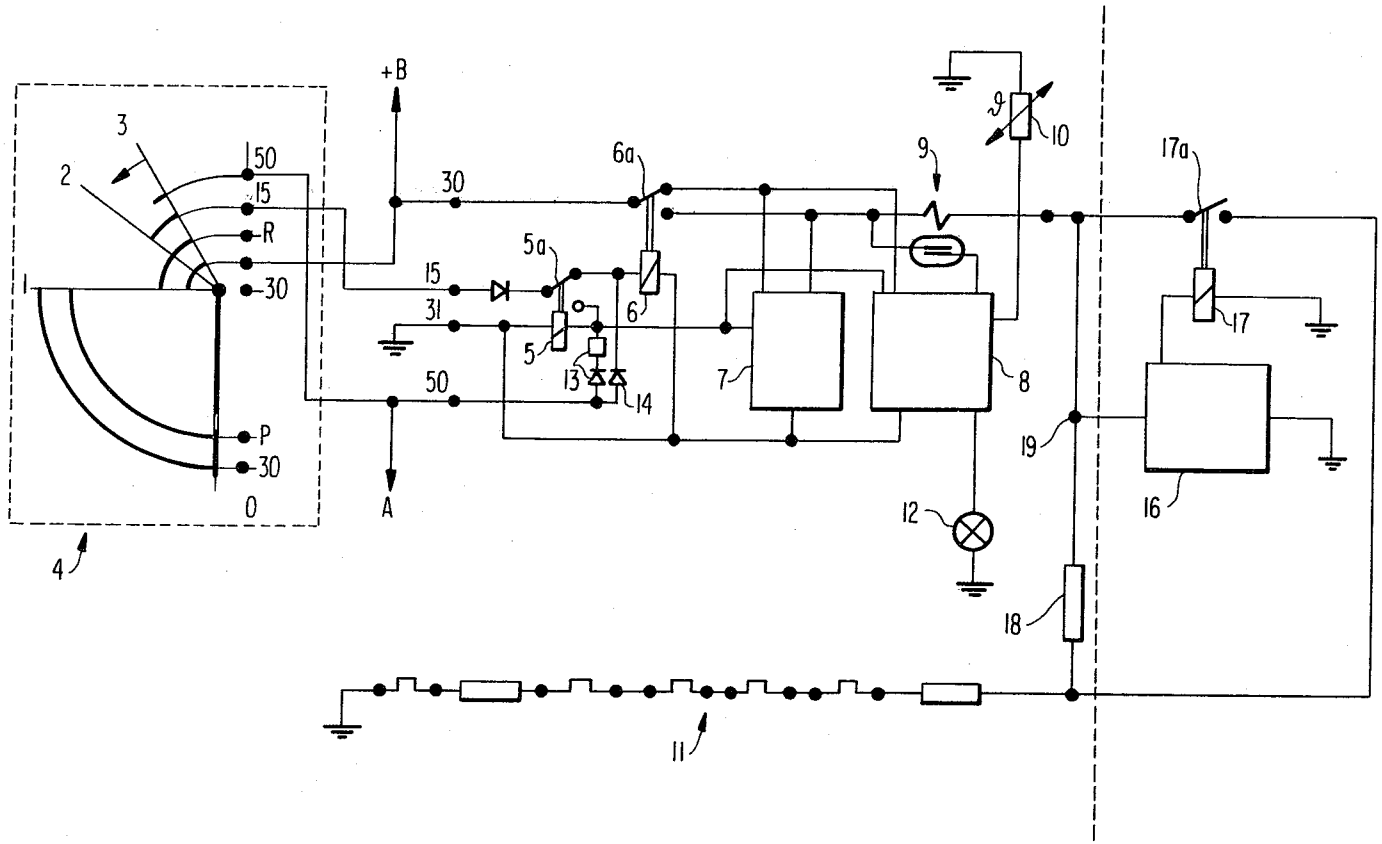
+B
A
30
15
31
50
5a
5
13
14
6a
6
7
8
9
10
12
11
17a
17
16
19
18
50
15
R
30
P
30
0
1
2
3
4

PRELIMINARY HEATING INSTALLATION FOR GLOW PLUGS IN AIR-COMPRESSING INTERNAL COMBUSTION ENGINES

This is a continuation of application Ser. No. 930,196 filed Aug. 2, 1978, now abandoned.

The present invention relates to a preliminary heating installation for glow plugs in air-compressing internal combustion engines, especially in motor vehicle internal combustion engines.

Customary preliminary heating installations for motor vehicles with diesel engines require, depending on the season, about ten to sixty seconds of time in order to produce a glow plug temperature of about 850° C. with a diesel engine not yet at operating temperature and with a heating current of about 55 A. It is the aim of the present invention to provide a preliminary heating installation which is capable of considerably shortening this preliminary heating period.

The underlying problems are solved according to the present invention in that a delay circuit is provided which, from the beginning of the preliminary heating, enables for a predetermined duration an increased heating current by an at least partial bridging or short-circuiting of the series resistance.

With an increase of the heating current to about twice the normal value, the glow plugs are heated to a temperature of about 800° C. to 900° C. in a very short period of time—for example, with a heating current of 100 A in one second. The advantage resides thereby in the fact that the engine can be started within the shortest period of time. The safe starting is assisted by a heating spiral for the preheating of the suction air, which is arranged in the suction air path of the internal combustion engine.

Accordingly, it is an object of the present invention to provide a preliminary heating installation for glow plugs in air-compressing internal combustion engines which avoids by simple means the aforementioned shortcomings and drawbacks encountered in the prior art.

Another object of the present invention resides in a preliminary heating installation for glow plugs of internal combustion engines of motor vehicles which considerably shortens the preliminary heating time required for a safe starting of the vehicle.

A further object of the present invention resides in a preliminary heating installation for glow plugs in air-compressing internal combustion engines which enhances the safe starting of the engine by extremely simple means.

Still a further object of the present invention resides in a control system for the glow plugs of diesel internal combustion engines which is simple in construction, reliable in operation and capable of completely automatic operation.

These and other objects, features and advantages of the present invention will become more apparent from the following description when taken in connection with the accompanying drawing which shows, for purposes of illustration only, one embodiment in accordance with the present invention, and wherein:

The single FIGURE is a schematic circuit diagram of a preliminary heating installation in accordance with the present invention.

Referring now to the single FIGURE of the drawing, the known customary preliminary heating installation is illustrated to the left of the vertical dash line and will be described at first.

The positive terminal +B of the battery, i.e., the terminal 30, is connected with the different electric loads at the terminals 30, 15 and 50 in a known manner by way of a conventional ignition lock generally designated by reference numeral 4 which has a position O=-OFF, a position 1=Parking position, a position 2=Preliminary Heating, respectively, Driving position and a position 3=non-stable Starting position. The permanent loads, i.e., the loads which remain continuously connected to the power supply, are connected to terminal 30 whereas the so-called daylight loads required in the preliminary heating/driving position are connected to terminal 15 and the loads required for starting are connected to the terminal 50.

The preliminary heating control installation consists of a first relay 5 with its two-position switching contact 5*a*, of a second relay 6 with its two-position switching contact 6*a*, of a conventional safety disconnect circuit 7, of an NTC evaluating circuit 8 of conventional type as well as of a reed relay generally designated by reference numeral 9 and of an indicator lamp 12; an NTC resistance 10, on the one hand, and the glow plugs 11 series-connected with a resistance 18, on the other, are connected to the NTC evaluation circuit 8.

If now the ignition lock 4 is moved into the preheating/driving position 2, then current flows from the positive terminal +B of the battery by way of terminal 15, contact 5*a* in the normal position with relay 5 de-energized and the energizing coil of relay 6. As a result thereof, relay 6 is energized and current flows from terminal 30 by way of the switching contact 6*a* with relay 6 energized, the energizing winding of the reed relay 9 by way of the series resistance 18 to the glow plugs 11 as well as by way of the closed reed contact to the NTC evaluation circuit 8. A condenser (not shown) was charged up while the relay contact 6*a* was in the normal position, i.e., with the relay 6 de-energized, which condenser is discharged in the preliminary/driving position by way of the temperature-dependent NTC resistance 10. This NTC resistance 10 has the higher a resistive value the lower the temperature of the engine. The indicating light 12 lights up during the discharge time of the condenser up to a predetermined voltage threshold. The extinction of the indicating lamp 12 is a signal for the fact that sufficient preheating has taken place and one can now start the engine. However, current continues to flow through the glow plugs 11. During the starting, i.e., in the position 3 of the ignition switch 4, current flows by way of terminal 50 to the starter A and to the energizing coil of the relay 5. The relay 5 becomes energized and remains self-holdingly in this position by way of a series circuit including resistance and diode 13 up to the instant when the ignition lock is turned off. As long as the starter A is actuated, the relay 6 remains energized by way of diode 14 and drops off or becomes de-energized only after the end of the starting operation, as a result of which the preliminary heating is terminated. If after the extinction of the indicating lamp 12, the engine fails to start, then the preliminary heating is continued until the safety circuit 7 which is adjusted to a predetermined time interval energizes the relay 5, as a result of which relay 6 drops off immediately, i.e., is de-energized immediately and the preliminary heating is terminated. If, however, as a result of an error in the preliminary heating circuit, too little current or no current flows, then the indicating lamp does not light up.

The described preliminary heating operation requires between 10 and 60 seconds of time. In modification of the known circuit, a current path is connected according to the present invention in parallel with the series resistance 18 or at least with a part thereof, which can be closed by a normally open operating contact 17*a* of a relay 17, as a result of which the series resistance 18 connected in parallel thereto is bridged or short-circuited. The relay 17 is energized and de-energized by a delay circuit 16 of any conventional construction which is connected between the point of connection 19 of the reed relay 9 with the series resistance 18, on the one hand, and ground, on the other. If a voltage is applied to the delay circuit 16, then it energizes relay 17 for a predetermined time, for example, for one second.

The preliminary heating operation now takes place as follows: As soon as the ignition lock 4 is brought into the position 2, relay 6 is energized, as described above, and current flows by way of the energizing winding 9, the series resistance 18 and the glow plugs 11. Lamp 12 lights up. At the same time, the delay circuit 16 and therewith relay 17 are energized so that the heating current—for example, 100 A—flows for about one second by way of normally open contact 17*a*, now closed, directly to the glow plugs 11. Thereafter, relay 17 is again de-energized by delay circuit 16 and a heating current, reduced by reason of the series connection of the series resistance 18, for example, 55 A, continues to flow through the heating circuit including the glow plugs 11 until either the lamp 12 becomes extinguished and the engine starts or the safety circuit 7 terminates the heating operation. In the circuit according to the present invention, an NTC resistance 10 with a different characteristic is provided, which takes into consideration the shorter preliminary heating time. This resistance 10 is still necessary only for engine temperatures below the freezing point, whereas with positive temperatures one can start the engine ordinarily immediately after the de-energization of relay 17.

It is particularly advantageous if the by-passed part of the series resistance is constructed as heating spiral arranged in the suction air path of the internal combustion engine, as a result of which the starting operation is considerably facilitated. However, this heating spiral may also be arranged in series with or in parallel with the glow plugs, separate from the series resistance. It is then possible to heat the heating spiral also with stepped current or to turn it on only after the turning off of the increased current. In principle, this preliminary heating circuit is applicable both to a series as also to a parallel connection of the glow plugs.

While I have shown and described only one embodiment in accordance with the present invention, it is understood that the same is not limited thereto but is susceptible of numerous changes and modifications as known to those skilled in the art, and I therefore do not wish to be limited to the details shown and described herein but intend to cover all such changes and modifications as are encompassed by the scope of the appended claims.

I claim:

1. In an air compressing internal combustion engine, a glow plug preheating circuit, comprising a resistor means at least in part in the intake air path of the internal combustion engine, and means for short-circuiting said resistor by either of two conditions, (a) entirely short-circuiting said resistor, and (b) short-circuiting a part of said resistor.

2. The invention, as set forth in claim 1, further characterized in that the said resistor means comprises a heating coil.

3. The invention, as set forth in claim 1, further characterized in that under condition (b) thereof, the part of the said resistor means not serving in short circuit comprises a heating coil.

4. The invention, according to claim 1, characterized in that said resistor means further comprises heating means in parallel with at least one glow plug.

* * * * *